United States Patent [19]

Kobayashi

[11] Patent Number: 4,957,287

[45] Date of Patent: Sep. 18, 1990

[54] TOY-GAME DEVICE

[75] Inventor: Toshio Kobayashi, Chiba Prefecture, Japan

[73] Assignee: Asahi Corporation, Tokyo, Japan

[21] Appl. No.: 273,221

[22] Filed: Nov. 18, 1988

[30] Foreign Application Priority Data

Nov. 21, 1987 [JP] Japan ..... 62-178205

[51] Int. Cl.[5] ..... A63F 9/00

[52] U.S. Cl. ..... 273/1.099

[58] Field of Search ..... 273/1 GD, 1 GE, 1 GF, 273/1 GG, 140

[56] References Cited

U.S. PATENT DOCUMENTS

| | | | |
|---|---|---|---|
| 3,565,425 | 2/1971 | Breslow | 273/1 GF |
| 3,721,440 | 3/1973 | Burns | 273/1 GG |
| 4,165,075 | 8/1979 | Popovich | 273/140 |
| 4,229,003 | 10/1980 | Shimazu | 273/1 GG XR |
| 4,366,957 | 1/1983 | Aldcroft et al. | 273/1 GF |
| 4,412,682 | 11/1983 | Rehkemper et al. | 273/1 GG |
| 4,746,125 | 5/1988 | Barlow | 273/1 GG X |

*Primary Examiner*—Paul E. Shapiro

*Attorney, Agent, or Firm*—Salter & Michaelson

[57] ABSTRACT

A toy-game device includes a base, a timer in the base actuatable for a set period of time, a rotatable platform operatively connected to the timer for rotation during the set period of time, a plurality of magnetically responsive game elements receivable on the platform, a receiving member on the base and a magnetic retrieving mechanism for retrieving the game elements from the platform and for depositing them in the receiving member. The game elements have opposite magnetically responsive and nonmagnetically responsive sides and the device includes a turnover mechanism for individually turning the game elements over to position the magnetically responsive sides thereof in upwardly facing relation so that they can be retrieved with the retrieving mechanism. The game device further includes an action element which is ejected from the base in the event that a predetermined number of the game elements have not been retrieved with the retrieving mechanism and deposited in the receiving member upon the expiration of the set period of time.

7 Claims, 4 Drawing Sheets

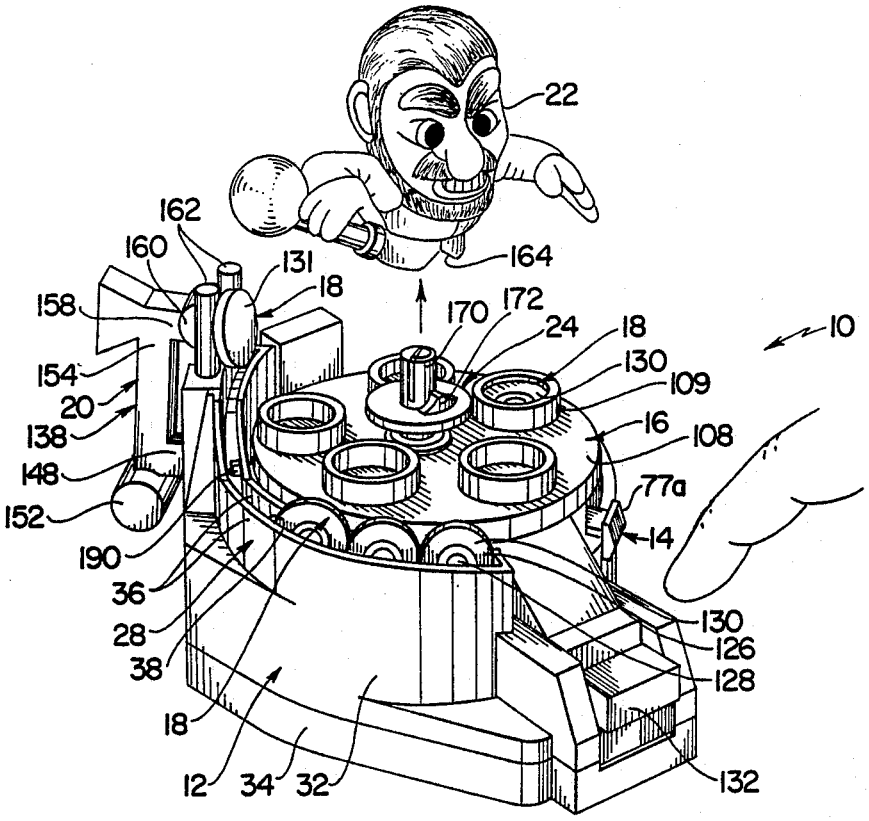
FIG. 3
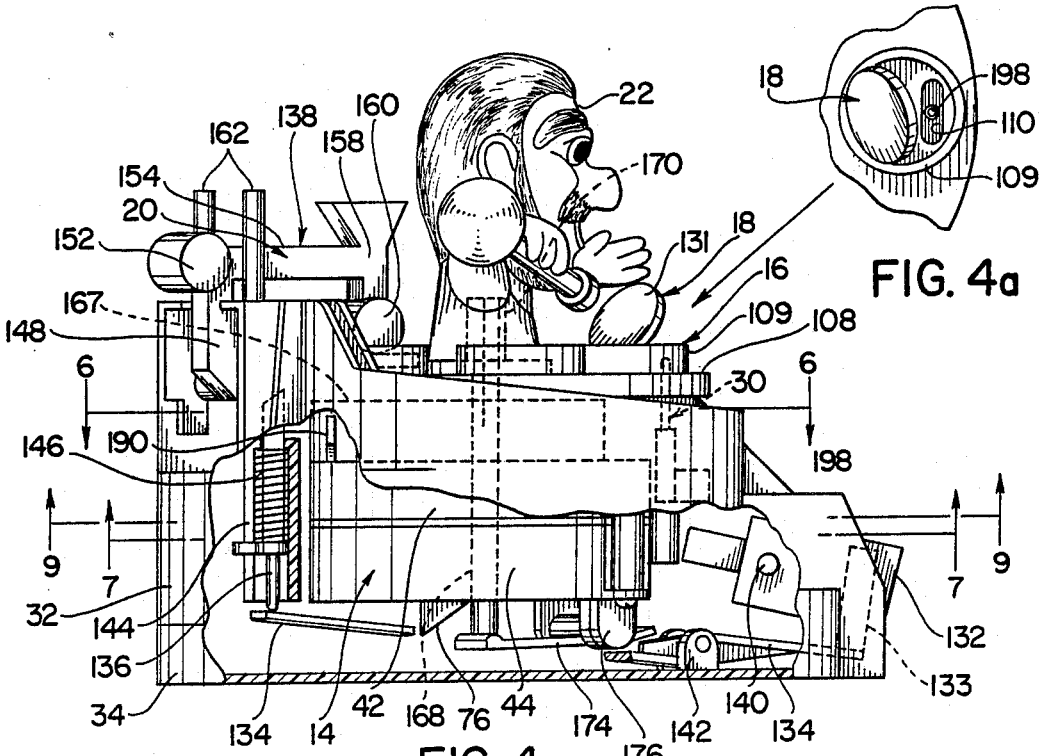
FIG. 4a
FIG. 4

TOY-GAME DEVICE

BACKGROUND OF THE INVENTION

The instant invention relates to amusement games and more particularly to a toy-game device of the general type wherein a game player must successfully perform certain predetermined manipulative activities within a set period of time in order to achieve a game score.

Game devices of the general type wherein game players are required to successfully perform certain manipulative activities within set periods of time have generally been found to have relatively high levels of appeal. Further, game devices of this type which are adapted to incorporate novel and interesting game activities and which are adapted to embody amusing game themes have been found to have particularly high levels of amusement value. It has also generally been found that game devices of this general type which are adapted for use by young children can enhance the development of hand-to-eye coordination and manual dexterity. Game apparatus of this general type are disclosed in the assignee's copending U.S. Pat. Nos. 129,822; 129,823; and 129,824; and, U.S. Pat. No. 4,783,074.

The instant invention provides an effective and amusing toy-game device of the general type wherein a game player must skillfully perform certain predetermined manipulative activities within a set period of time in order to achieve a game score. Specifically, the toy-game device of the instant invention comprises a base, a timer in the base which is actuatable for a set period of time, a rotatable platform on the base which is operatively connected to the timer for rotation during the set period of time, and a plurality of substantially flat game discs which are receivable on the platform for rotation therewith. The toy-game device further comprises retrieving means for retrieving the game discs from the platform, an action element on the base, and means operative for oscillating the action element back and forth during the set period of time and for ejecting the action element from the base upon the expiration of the set period of time. One of either the retrieving means or each of the game discs includes magnetic means, and the other of either of the retrieving means or each of the game discs includes magnetically responsive means and the retrieving means is operative for magnetically retrieving the game discs from the platform. The game device preferably further includes means for individually turning the game discs over to position the magnetic means or the magnetically responsive means thereon in upwardly facing relation so that the game discs can be magnetically retrieved from the platform by the retrieving means. In addition, the toy-game device preferably includes a receiving member having a receiving slot therein and the retrieving means is preferably operative for retrieving the game discs from the platform and for depositing them in the receiving slot in the receiving member. Still further, the toy-game device preferably includes a timer locking mechanism for preventing the operation of the ejecting means in the event that a predetermined number of the game discs have been received in the receiving member during the set period of time.

Accordingly, for use and operation of the toy-game device of the instant invention, a plurality of the game discs are positioned on the platform with the magnetic or magnetically responsive elements thereon facing downwardly and the timer is actuated for a set period of time. As the platform is rotated, the means for turning the game discs over is operated to individually turn the game discs over so that the magnetic or magnetically responsive elements thereon face upwardly. Once a game disc has been turned over in this manner, the retrieving means can be operated to individually retrieve the game elements and deposit them in the slot in the receiving means. In the event that a predetermined number of the game discs have been deposited in the receiving means before the expiration of the set period of time the timer locking mechanism is operative for preventing the ejecting means from ejecting the action element. However, in the event that an insufficient number of game discs have been deposited in the receiving means during the set period of time, the ejecting means is operative for ejecting the action element upon the expiration of the set period of time.

Accordingly, it is a primary object of the instant invention to provide an effective and amusing toy-game device which is operative in connection with a game wherein a game player must perform certain predetermined manipulative activities within a set period of time in order to achieve a game score.

Another object of the instant invention is to provide a toy-game device having an amusing and interesting game theme.

An even further object of the instant invention is to provide a toy-game device wherein game discs must be magnetically retrieved and deposited in a receiving slot within a set period of time in order to achieve a game score.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a similar perspective view illustrating the operation of the ejecting mechanism;

FIG. 4 is a side elevational view of the game device as operated in FIG. 2;

FIG. 4A is a fragmentary top plan view of a portion of the platform and one of the game discs;

DESCRIPTION OF THE INVENTION

Figure 1:
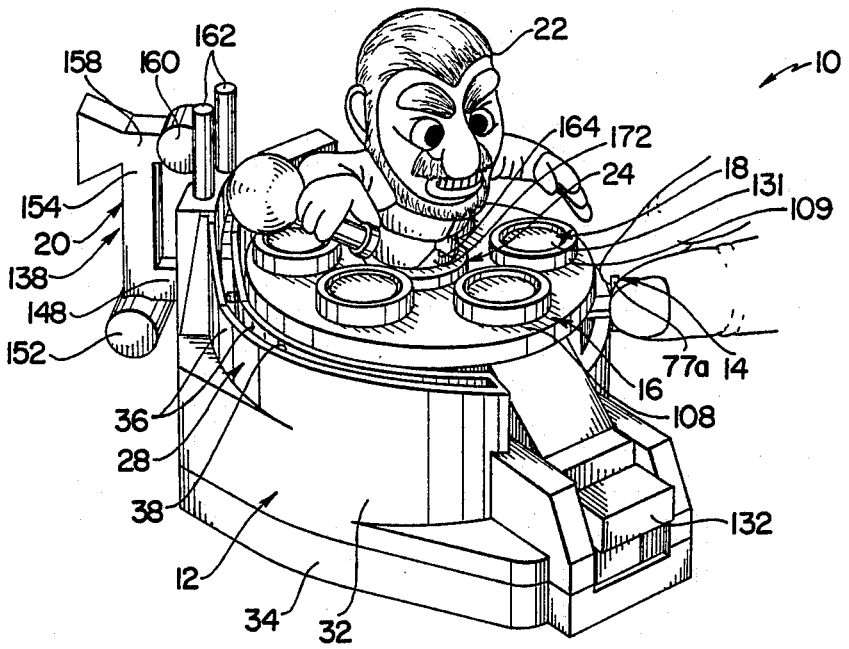
FIG. 1 is a perspective view of the toy-game device of the instant invention illustrating the operation of the timer.
Figure 2:
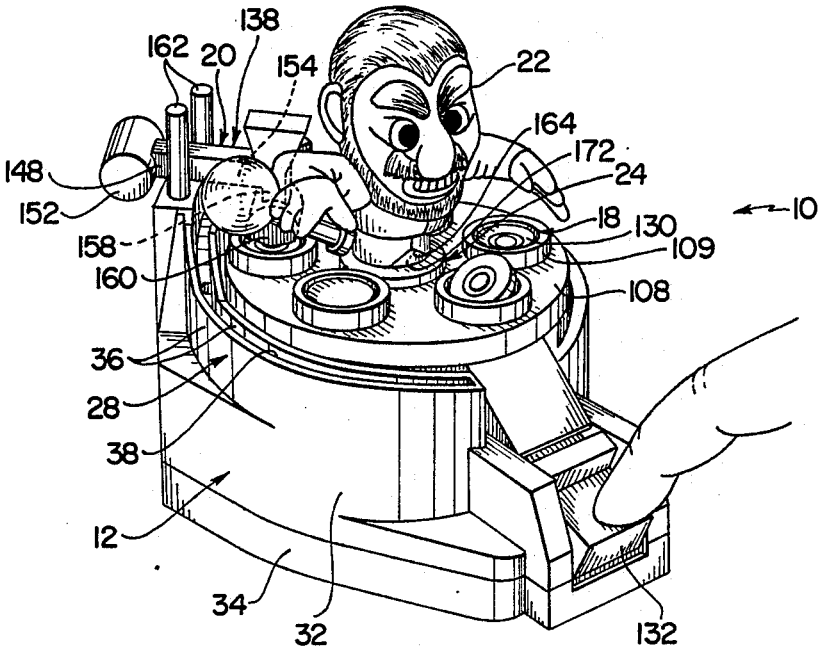
FIG. 2 is a similar perspective view illustrating the operation of the retrieving mechanism and the turnover mechanism.

Referring now to the drawings, the toy-game device of the instant invention is illustrated in FIGS. 1–9 and generally indicated at 10 in FIGS. 1–5. The toy-game device 10 comprises a base generally indicated at 12, a timer generally indicated at 14 in the base 12, a rotatable platform assembly generally indicated at 16 on the base 12, a plurality of game elements generally indicated at 18, and a retrieving mechanism generally indicated at 20. The game device 10 further comprises an action element 22, an action element operating mechanism generally indicated at 24, a timer locking mechanism generally indicated at 26 (see FIG. 7A) a receiving member generally indicated at 28, and a game element turnover mechanism generally indicated at 30. During operation of the toy-game device 10 a plurality of the game elements 18 are positioned on the platform 16 and the timer 14 is actuated for a set period of time. The turnover mechanism 30 can then be operated during the set period of time for turning the game elements 18 over on the platform 16 and the retrieving mechanism 20 can be operated for retrieving the turned over game elements 18 from the platform 16 and for depositing them in the receiving member 28. Upon the expiration of the set period of time as determined by the timer 14, the operating mechanism 24 is normally operative for ejecting the action element 22 in the manner illustrated in FIG. 3. However, in the event that a predetermined number of the game elements 18 have been deposited in the receiving member 28 during the set period of time, the timer locking mechanism 26 is operative for preventing the operation of the operating mechanism 24 to eject the action element 22 upon the expiration of the set period of time.

The base 12 is preferably molded from a suitable plastic material and it comprises upper and lower housing sections 32 and 34, respectively, which cooperate to define a housing for containing the timer 14 and portions of the retrieving mechanism 20, the operating mechanism 24, the turnover mechanism 30, and the timer locking mechanism 26. The receiving member 28 is integrally formed with the upper housing section 32 and it includes a pair of spaced arcuate vertically disposed wall portions 36 which cooperate to define an arcuate downwardly inclined slot 38 therebetween.

Referring now to FIGS. 6–9, the timer 14 is more clearly illustrated. The timer 14 includes a housing generally indicated at 40 comprising upper and lower housing sections 42 and 44, respectively, which are separated by a partition 46. The timer 14 further comprises a winding mechanism generally indicated at 48 which is contained in the lower housing section 44 and a decay mechanism generally indicated at 50 which is contained in the upper housing section 42. The main operative components of the timer locking mechanism 26 are also contained in the lower housing section 44 and will hereinafter be more fully set forth.

Figure 7:
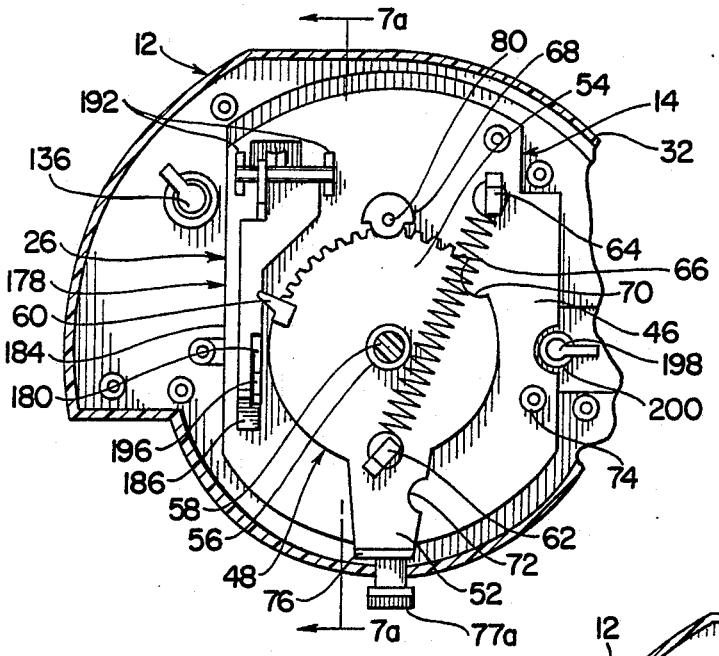
FIG. 7 is a sectional view taken along line 7—7 in FIG. 4.
Figure 8:
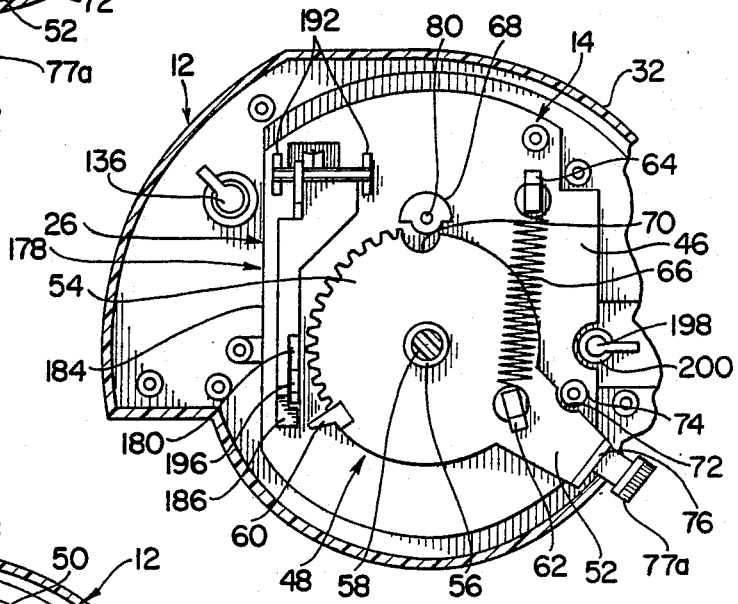
FIG. 8 is a sectional view similar to FIG. 7 with the timer in the unwound position thereof.

The winding mechanism 48 is illustrated most clearly in FIGS. 7 and 8 and it comprises a winding arm 52 which is integrally formed with a fan gear 54. The winding arm 52 and the fan gear 54 are rotatably received on a hub 56 which defines an opening 58 in the partition 46. A lug 60 is integrally formed at one end of the fan gear 54 and a lug 62 is integrally formed at an intermediate point on the winding arm 52. Formed on the partition 46 is a lug 64 and a winding spring 66 extends between the lugs 62 and 64 in order to bias the winding arm 52 toward the unwound position illustrated in FIG. 8. In this regard, the winding spring 66 is positioned so that when the winding arm 52 is rotated to a fully wound position, the spring 66 bends around the hub 56 in order to more effectively bias the winding arm 52 toward the unwound position thereof. An open gear housing 68 is integrally formed on the partition 46 and the fan gear 54 is oriented so that it passes through the open gear housing 68 as the winding arm 52 is moved between the wound and unwound positions thereof. The fan gear 54 communicates with the decay mechanism 50 in the housing 68 to retard the advancement of the winding mechanism 48 toward the unwound position. However, one end of the fan gear 54 is defined by an arcuate notch 70 so that the fan gear 54 is disengaged from the decay mechanism before the winding arm 52 reaches the fully unwound position. A notch 72 is formed on the winding arm 52 and a mounting lug 74 is formed on the partition 46 and it is receivable in the notch 72 when the winding arm 52 reaches the fully unwound position thereof as illustrated in FIG. 8. Formed at the outer end of the winding arm 52 is a vertically disposed actuating arm 76 which is engageable with the character figure operating mechanism 24 for reasons which will hereinafter be more fully set forth. Also included in the winding mechanism 48 is an upper winding arm 77 which is rotatably mounted on the upper wall of the upper timer housing section 42 so that it is engageable with the actuating arm 76 for advancing the winding arm 52 toward the wound position thereof. The upper winding arm 77 is disengageable from the winding arm 52 when the upper winding arm 77 is moved toward an unwound position so that the upper winding arm 77 cannot be used for manually accelerating the advancement of the timer 14 toward an unwound position. An end piece 77*a* is attached to the cuter end of the upper winding arm 77 for moving the upper winding arm 77 toward the wound position.

Figure 9:
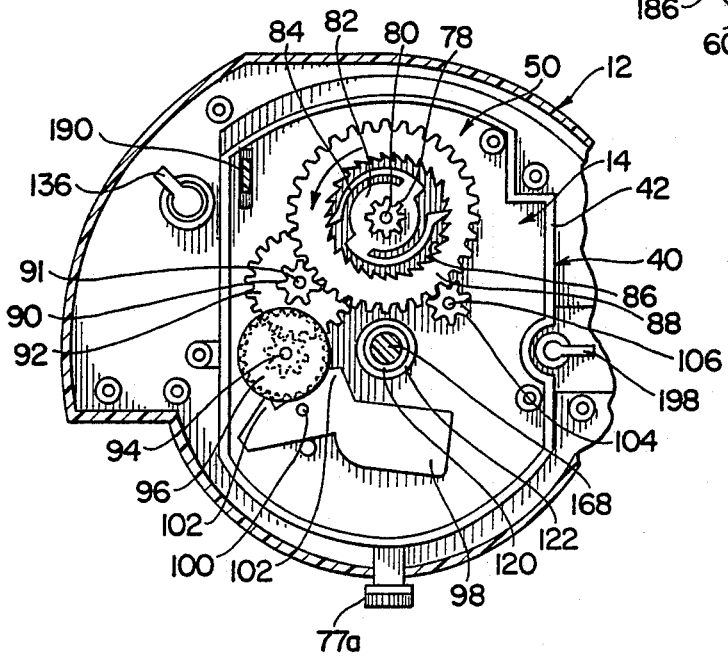
FIG. 9 is a sectional view taken along line 9—9 in FIG. 4.

Referring now to FIG. 9, the decay mechanism 50 comprises a main drive gear 78 which is mounted on a shaft 80 and integrally formed with a ratchet ring 82. The main drive gear 78 is received in the open gear housing 68 so that it can intermesh with the fan gear 54 as the fan gear 54 is passed through the housing 68. The ratchet ring 82 includes a pair of resilient ratchet arms 84 and it is received in a circular recess 86 in a main transmission gear 88. The recess 86 has a plurality of peripheral teeth formed therein and the ratchet arms 84 are engageable with the teeth in the recess 86 in order to communicate rotation to the main transmission gear 88 in the direction indicated. However, when the ratchet ring 82 is rotated in a reverse direction, the resilient ratchet arms 84 pass over the teeth in the recess 86 so that rotation is not communicated to the main transmission gear 88. The main transmission gear 88 intermeshes with a reduced intermediate transmission gear 90 which is mounted on a shaft 91 and integrally formed with an enlarged intermediate transmission gear 92. The enlarged transmission gear 92 intermeshes with an escapement wheel gear 94 which is integrally formed with an escapement wheel 96 having a plurality of peripheral v-shaped teeth thereon. An escapement arm 98 is pivotably mounted on a post 100 which is formed on the upper side of the partition 46. The escapement arm 98 includes a pair of opposed jaws 102 which are alternatively engageable with the V-shaped teeth on the escapement wheel 96 to oscillate the escapement arm 98 back and forth as the escapement wheel 96 is rotated.

As a result, the escapement wheel 96 and the escapement arm 98 cooperate to control or retard the rate at which the gears in the decay assembly 50 are rotated and they also cooperate to produce a ticking sound from the timer 14 as the winding arm 52 is advanced towards an unwound position. Also included in the decay mechanism 50 is a platform drive gear 104 which is mounted on a shaft 106 so that it intermeshes with the main transmission gear 88. The shaft 106 extends upwardly through the upper wall of the upper housing section 42 for communicating rotation to the platform mechanism 16 as will hereinafter be more fully set forth.

Accordingly, for operation of the timer 14 the winding arm 52 is advanced to a wound position for driving the decay mechanism 50. In this connection, as the winding arm 52 is advanced towards a wound position, the fan gear 54 engages the main drive gear 78 to rotate the ratchet ring 82 in a direction which causes the ratchet arms 84 to pass over the teeth in the recess 86. When the winding arm 52 is thereafter released, it is advanced towards an unwound position by the spring 66 and the ratchet arms 84 engage the teeth in the recess 86 to rotate the main transmission gear 88 in the direction illustrated. This causes rotation to be communicated to the shaft 91 and it also causes rotation to be communicated to the escapement wheel 96 so that the escapement arm 98 oscillates back and forth to control the rate of advancement of the winding arm 52 towards the unwound position thereof. Further, as the main transmission gear 88 is rotated, the platform drive gear 104 is also rotated to rotate the shaft 106.

The platform mechanism 16 includes a substantially circular platform element 108 having a plurality of integrally formed circular rings 109 thereon and having a plurality of elongated apertures 110 which extend through the areas of the platform element which are surrounded by the rings 109. The platform element 108 has a central opening 111 formed therein and a neck 112 extends downwardly in concentric relation around the opening 111. The neck 112 has a downwardly facing gear face 114 formed at the lower end thereof. A reduced upper platform gear 116 is received and secured on the shaft 106 on the upper side of the upper wall of the upper housing section 42. The reduced upper platform gear 116 intermeshes with an enlarged upper platform gear 118 which is rotatably received on a tubular member 120 which is in turn rotatably received in a tubular sleeve 122 (see FIGS. 5 and 9) in the central portion of the upper timer housing section 42. The enlarged upper platform gear 118 is integrally formed with a gear ring 124 having an upwardly facing gear face thereon which intermeshes with the gear face 114 to rotate the platform element 108 as the timer 14 is advanced towards an unwound position.

The game elements 18 preferably comprise substantially flat circular plastic discs 126 having magnetically responsive elements 128 thereon. The game elements 18 have first sides 130 on which the magnetically responsive elements 128 are exposed and second sides 131 which are defined entirely by the plastic discs 126.

The game element retrieving mechanism 20 is illustrated most clearly in FIGS. 1 through 5 and it comprises a depressible member 132, a linkage arm 134 having an upwardly extending post 135 thereon, a linkage pin 136, and a retrieving member 138. The depressible member 132 includes a pair of pins 140 which extend outwardly from opposite sides thereof and are received in slots (not shown) in the upper base portion 32 in order to pivotably mount the depressible member 132 therein. The post 135 engages the underside of the depressible member 132 and the depressible member 132 is movable between the normal position illustrated in FIG. 5 and the depressed position illustrated in FIG. 4 in order to pivot the linkage member 134 between the normal position illustrated in FIG. 5 and the pivoted position illustrated in FIG. 4. In this connection, the linkage member 134 is pivotably mounted in a pair of pivot mounts 142 which are integrally formed on the lower base portion 34 and the linkage member 134 extends rearwardly in the lower base portion 34 to a point adjacent the rear end thereof. The linkage pin 136 is received in a vertically disposed slotted tubular member 144 which is integrally formed on the upper housing section 32 and a coil spring 146 is received on the linkage pin 136 for biasing it downwardly to the position illustrated in FIG. 5. The rear end of the linkage member 134 is positioned so that it is aligned with the lower end of the linkage pin 136 and accordingly, by depressing the depressible member 132, the linkage member 134 is engageable with the linkage pin 136 to move it upwardly to the actuated position illustrated in FIG. 4. The upper end of the linkage pin 136 is positioned so that it is engageable with the retrieving member 138 in order to move the retrieving member 138 from the unactuated position illustrated in FIGS. 1,3 and 5 to the actuated or retrieving position illustrated in FIGS. 2 and 4. In this regard, the retrieving member 138 includes a lower arm portion 148 which is pivotably mounted in the upper base portion 32 with a pair of pins 150. The retrieving member 138 further includes a weighted element 152 which is mounted on the outer end of the lower arm portion 148, and an upwardly extending intermediate arm portion 154 which extends upwardly from the weighted element 152. Attached to the upper end of the intermediate arm portion 154 is an upper retrieving arm 156 and a magnetic portion 160 containing a magnet (not shown) is attached to the upper arm 158. The retrieving member 138 is further formed so that when the upper end of the linkage pin 136 engages the lower arm portion 148, the entire retrieving member 138 is pivoted upwardly and inwardly so that the magnetic portion 160 can be utilized for individually retrieving the game elements 18 from within the rings 109. In this regard, the retrieving mechanism 20 is formed so that the depressible member 132 must be sharply depressed so that the momentum of the weighted element 152 causes the retrieving member 138 to be moved to the fully pivoted position illustrated in FIGS. 2 and 4. However, the retrieving member 138 is further constructed so that when the depressible member 132 is released and the spring 146 moves the linkage pin 136 downwardly to the normal position thereof, the weighted element 152 causes the retrieving member 138 to be returned to the unactuated position illustrated in FIGS. 1,3 and 5. The magnetic element 160 is positioned on the retrieving member 138 so that when the retrieving member 138 is moved to the inwardly pivoted retrieving position thereof, it is individually engageable with the upwardly facing magnetically responsive elements 128 on the game elements 18 positioned in the rings 109 as the game elements 18 pass by the retrieving member 138. As a result, the retrieving member 138 can be utilized for individually retrieving the game elements 18 from the rings 109 and for individually moving the game elements 18 to the retrieved position illustrated in FIGS. 3 and 5. Further, the retrieving mechanism 20 also includes a pair of spaced posts 162 which are positioned on opposite sides of the path traveled by the magnetic element 160 as it moves between the unactuated and the actuated positions thereof. Specifically, the posts 162 are positioned so that as the retrieving member 138 is returned to the unactuated position thereof the posts 162 disengage a game element 18 magnetically attached to the magnetic element 160 so that the game element 18 falls into the receiving member 28.

The action FIG. 22 is preferably formed as an amusing character figure such as illustrated in FIGS. 1 through 5 and it includes a socket (not shown) which is formed in the lower end thereof. The action element 22 further includes a v-shaped notch 164 in the lower end thereof which is positioned so that it extends outwardly from the downwardly facing socket (not shown) in the lower end of the action element 22.

Figure 5:
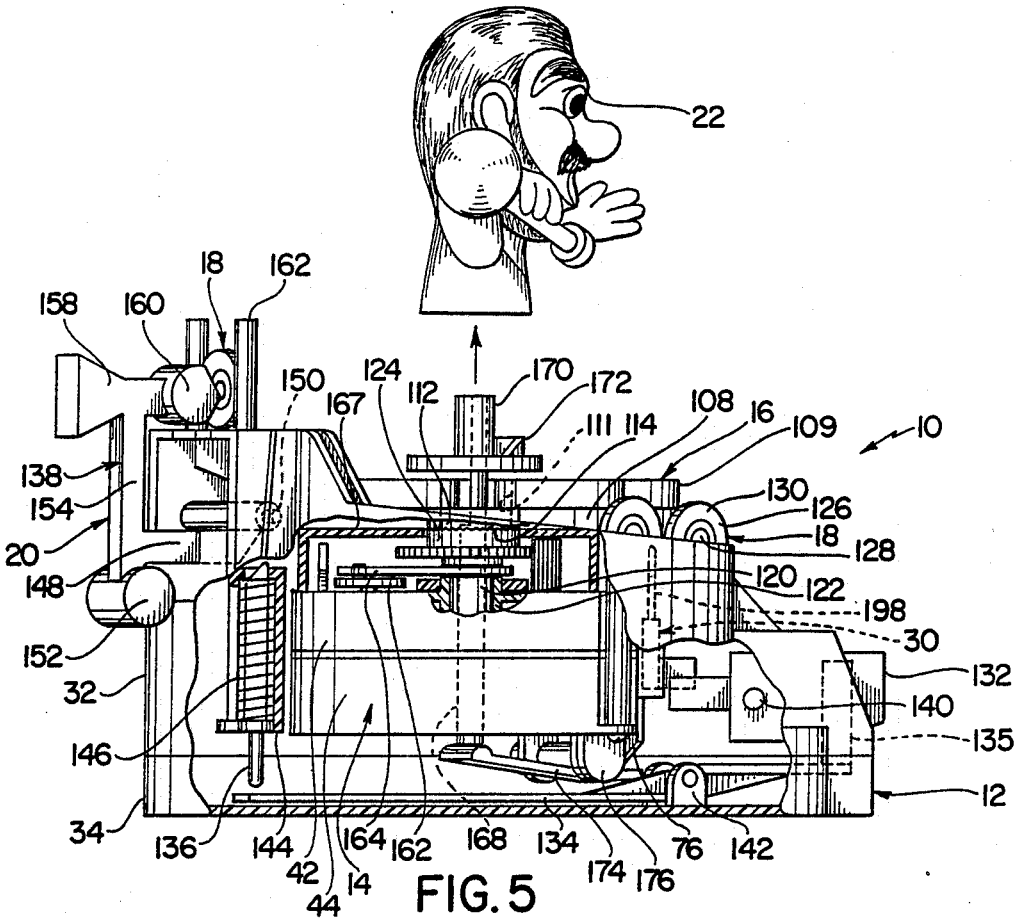
FIG. 5 is a side elevational view of the device as operated in FIG. 3.
Figure 6:
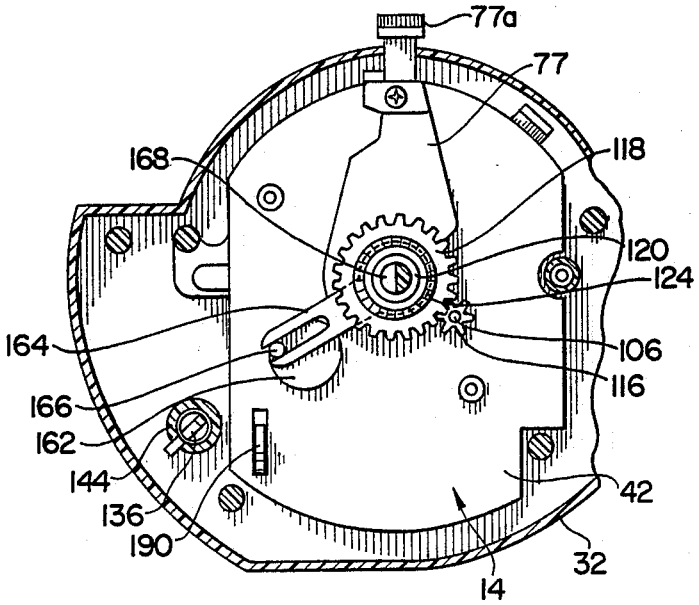
FIG. 6 is a sectional view taken along along line 6—6 in FIG. 4.

The action element operating mechanism 24 is operative for moving the action element 22 so that it oscillates back and forth as the timer 14 is advanced from the wound position thereof toward the unwound position thereof and it is further operative for ejecting the action element 22 in the manner illustrated in FIGS. 3 and 5 when the timer 14 reaches the fully unwound position thereof in the event that all of the game elements 18 have not been received in the slot 38. In this regard, as illustrated in FIG. 6, the action element operating mechanism 24 includes an eccentric disc 162 which is mounted on the upper end of the shaft 91 so that it rotates with the intermediate transmission gears 90 and 92, and a slotted arm 164 which is integrally attached to the tubular member 120. The eccentric disc 162 includes a pin 166 which is received in a slot in the slotted arm 164 so that the slotted arm 164 rotates the tubular member 120 back and forth as the eccentric disc 162 is rotated. The eccentric disc 162 and the slotted arm 164 are mounted on the upper wall of the upper timer housing section 42 and contained in an upper subhousing 167. Further included in the action element operating mechanism 24 is a shaft 168 which is nonrotatably received in the tubular member 120 but nevertheless longitudinally repositionable therein. The shaft 168 extends downwardly through the timer 14 and an action element base 170 is received and secured on the upper end of the shaft 168. The base 170 is loosely receivable in the socket (not shown) in the lower end of the action element 22 and a V-shaped upwardly facing projection 172 is formed on the base 170. The projection 172 is receivable in the notch 164 in the action element 22 so that the action element 22 rotates with the base 170. Accordingly, as the timer 14 is advanced towards the unwound position thereof, the slotted arm 164 communicates with the eccentric disc 162 to oscillate the tubular member 120, the shaft 168, the base 170, and the action element 122 back and forth. The action element operating mechanism 24 further comprises a lever 174 which is pivotably mounted in a pair of lever mounts 176 on the underside of the lower timer housing section 44. The lever 174 is positioned so that it is engageable with the lower end of the shaft 168 in order to advance the shaft upwardly to eject the action element 22. The lever 174 is further positioned so that it is engageable by the actuating arm 76 to pivot the inner end of the lever 174 upwardly as the timer 14 reaches the fully unwound position thereof. In this regard, because the winding arm 52 is rapidly advanced toward the unwound position thereof, once the fan gear 54 is disengaged from he drive gear 78, the actuating arm 76 sharply engages the lever 174 so that the shaft 168 is rapidly propelled upwardly to eject the action element 22 as the timer 14 reaches the fully unwound position thereof.

Figure 7A:
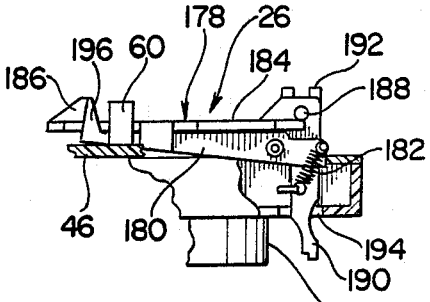
FIG. 7A is a fragmentary sectional view taken along line 7A—7A in FIG. 7.

The timer locking mechanism 26 is illustrated in FIGS. 7, 7A and 8, and it is operative for preventing the operation of the action element operating mechanism 24 to eject the action element 22 in the event that a predetermined number of the game elements 18 have been received in the receiving member 28 upon the expiration of a set period of time as determined by the timer 14. The timer locking mechanism 26 comprises a main latching member generally indicated at 178, a follower member 180, and a spring 182. The main latching member 178 includes a latching arm 184 having a latch element 186 formed thereon, a pivot pin 188 and an upwardly extending actuating finger 190. The pivot pin 188 is received in a pair of mounts 192 which are integrally formed on the under side of the partition 46 in order to pivotably mount the main latching member 178 so that the actuating finger 190 passes through an opening 194 in the bottom of the slot 38. The latching mechanism 26 is constructed so that the main latching member 178 is normally gravitationally retained in the position illustrated in the inverted view shown in FIG. 7A wherein the main latching member 178 is spaced downwardly from the partition 46. The acuating finger 190 is positioned in the slot 38 so that when a predetermined number of the game elements 18 have been received in the receiving slot 38 the last game element 18 received therein is engageable with the actuating finger 190 in order to retain the main latching member 178 in the pivoted position illustrated in FIG. 7A. The follower element 180 is pivotably mounted on the main latching member 178 and it is normally retained in the pivoted position illustrated in FIG. 7A by the spring 182. The follower element 180 includes a follower finger 196 having an angularly disposed leading edge thereon. The leading edge of the follower finger 196 is engageable with the lug 60 to cause the main latching member 178 to pivot upwardly over the lug 60 when the timer 14 approaches the fully unwound position thereof in the event that the actuating finger 190 is not in engagement with one of the game elements 18 in the slot 38. On the other hand, if the actuating finger 190 is in engagement with one of the game elements 18 in the slot 38 so that the main latching element 178 cannot pivot upwardly toward the partition 46, the follower finger 196 cams on the lug 60 to pivot the follower element 180 toward the partition 46. When this occurs, the leading edge of the latch element 186 is engageable with the lug 60 to prevent the winding arm 52 from reaching the fully unwound position thereof. Consequently, the locking mechanism 26 is operative for preventing the actuating arm 76 from engaging the lever 174 to eject the action element 22. In other words, when a predetermined number of the game elements 18 have been received in the receiving member 28, the timer locking mechanism 26 is operative for preventing the ejection of the action element 22.

The game element turnover mechanism 30 is illustrated most clearly in FIGS. 4, 4A and 5 and it comprises a turnover pin 198 which is slidably received in a sleeve 200 which is integrally formed in the upper housing section 32. The pin 198 is positioned so that the lower end thereof is engageable by the depressible member 132 to advance the pin 198 upwardly in the sleeve 200 when the depressible member 132 is depressed downwardly. The pin 198 is further positioned so that when one of the rings 109 is substantially aligned with the depressible member 132 as the platform element 108 is rotated, the pin 198 can be advanced upwardly through the aperture 110 (see FIG. 4A) in the ring 109 in order to turn a game element 18 in the ring 109 over. In this regard, the pin 198 is dimensioned and weighted so that when it is aligned with one of the apertures 110 and the depressible member 132 is depressed sharply, the pin 198 is propelled upwardly through the aperture 110 into engagement with a game element 18 in order to turn the game element 18 over as illustrated in FIGS. 4 and 4A. However, after the pin 198 reaches the upper extent of its travel in the sleeve 200, it is immediately gravitationally retracted so that it does not interfere with the further rotation of the platform element 108.

Accordingly, for use and operation of the toy-game device 10 the action element 22 is assembled on the base 170, and the game elements 18 are positioned in the rings 109 so that the nonmagnetic second sides 131 of the game elements 18 face upwardly. The timer 14 is then actuated by moving the winding arm 52 to the fully wound position thereof so the timer 14 operates to rotate the platform element 108 and to oscillate the action element 22 through the action element operating mechanism 24. As the platform element 108 is rotated, the depressible member 132 can be depressed at the appropriate times so that the pin 198 individually engages the game elements 18 to turn them over in their respective rings 109 in the manner illustrated in FIGS. 4 and 4A. Once a game element 18 has been turned over in its recess 110 so that the first side 130 thereof faces upwardly, the turned over game element 18 can be retrieved with the retrieving mechanism 20 as the game element 18 passes by the posts 162. Specifically, by again sharply depressing the depressible member 132, the retrieving member 138 can be pivoted forwardly to cause the magnetic element 160 to engage the magnetically responsive element 128 of the turned over game element 18. As the retrieving member 138 is then pivoted rearwardly by the weighted element 152, the game element 18 remains attached to the magnetic element 160 until it engages the posts 162 whereupon the game element 18 is deposited in the slot 38 in the receiving member 28. Thereafter, additional game elements 18 can be turned over with the turnover mechanism 30 and retrieved with the retrieving mechanism 20 in a similar manner until the set period of time as determined by the timer 14 has expired. In this regard, in the event that all of the game elements 18 have been retrieved with the retrieving mechanism 20 and deposited in the receiving member 28 before the expiration of the set period of time, the locking mechanism 26 operates to prevent the action element operating mechanism 24 from ejecting the action element 22. Specifically, the last game element 18 positioned in the receiving member 28 engages the actuating finger 190 so that the latch element 186 engages the lug 60 to prevent the winding arm 52 from being advanced to the fully unwound position thereof. However, in the event that all of the game elements 18 have not been deposited in the receiving member 28 before the expiration of the set period of time, the follower element 196 causes the locking mechanism 26 to pivot over the lug 60 so that the leg 76 on the winding arm 52 engages the lever 174 to advance the shaft 168 upwardly so that the action element 22 is ejected from the operating mechanism 24 in the manner illustrated in FIGS. 3 and 5.

It is seen therefore that the instant invention provides an effective action toy-game device which is operative for playing a game of the general type wherein a game player must perform certain manipulative activities within a set period of time in order to achieve the game score. Specifically, the game device 10 is operative for playing an amusing game wherein game players must turn the game elements 18 over and then retrieve the game elements 18 with the retrieving mechanism 20 before the expiration of a set period of time as determined by the timer 14. Accordingly, the game device 10 requires game players to skillfully perform a series of challenging manipulations within the set period of time. Hence, it is seen that the toy-game device of the instant invention has a high degree of amusement value and that it represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy-game device comprising a base, a timer in said base actuatable for a set period of time, a rotatable platform on said base operatively connected to said timer for rotation during said set period of time, a plurality of game elements receivable on said platform, retrieving means for retrieving said game elements from said platform, one of either said retrieving means or each of said game elements including magnetic means, the other of either said retrieving means or each of said game elements including magnetically responsive means, said game elements comprising substantially flat circular game discs, said device further comprising receiving means having an elongated, upwardly open, gradually downwardly inclined receiving slot therein, said retrieving means being operative for magnetically retrieving said game discs from said platform and for depositing them in on-edge dispositions in said slot so that they roll downwardly therein, an action element on said base and means operative for ejecting said action element from said base upon the expiration of said set period of time.

2. The toy-game device of claim 1 further comprising means for preventing the operation of said ejecting means after a predetermined number of said game discs have been received in said slot.

3. The toy-game device of claim 1 further comprising said receiving means being located on said base game, and means for preventing the operation of said ejecting means when a predetermined number of said game elements have been received in said receiving means.

4. A toy-game device comprising a base, a timer in said base actuatable for a set period of time, a rotatable platform on said base operatively connected to said timer for rotation during said set period of time, a plurality of substantially flat game discs receivable on said platform, retrieving means for retrieving said game discs from said platform, one of either said retrieving means or each of said game discs including magnetic means, the other of either said retrieving means or each of said game discs including magnetically responsive means, said magnetic means or said magnetically responsive means on each of said game discs being exposed on only one side of each of said game discs, means for individually selectively turning said game discs over to position the magnetic means or the magnetically responsive means thereon in upwardly facing relation on said platform, said retrieving means being operative for magnetically retrieving only those game discs positioned on said platform so that the magnetic means or the magnetically responsive means thereon are in upwardly facing relation.

5. A toy-game device comprising a base, a timer in said base actuatable for a set period of time, a rotatable platform on said base operatively connected to said timer for rotation during said set period of time, a plurality of substantially flat game discs receivable on said platform, receiving means having an upwardly open slot therein, retrieving means for retrieving said game discs from said platform, one of either said retrieving means or each of said game discs including magnetic means, the other of either said retrieving means or each of said game discs including magnetically responsive means, said retrieving means being operative for magnetically retrieving said game discs from said platform and for depositing them in said slot, the magnetic means or the magnetically responsive means on each of said game discs being exposed on only one side of each of said game discs, means for individually selectively turning said game discs over to position the magnetic means or the magnetically responsive means thereon in upwardly facing relation, said retrieving means being operative for retrieving only those game discs positioned on said platform so that the magnetic means or the magnetically responsive means thereon are in upwardly facing relation, an action element on said base and means operative for ejecting said action element from said base upon the expiration of said set period of time.

6. In the toy-game device of claim 5, said means for turning said game discs over being operatively connected to said retrieving means for operating simultaneously therewith on different game discs.

7. In the toy-game device of claim 5, said means for turning said game discs over including means individually engageable with the downwardly facing surfaces of said game discs for individually turning said game discs over.

* * * * *